US012768232B2

(12) United States Patent
Jones et al.

(10) Patent No.: US 12,768,232 B2
(45) Date of Patent: Oct. 20, 2026

(54) HIGH TEMPERATURE GEOTHERMAL WELL TRACTOR

(71) Applicant: HALLIBURTON ENERGY SERVICES, INC., Houston, TX (US)

(72) Inventors: Christopher Jones, Houston, TX (US); Gary Kainer, Tomball, TX (US); Sudhir Gupta, Kingwood, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 19/053,462

(22) Filed: Feb. 14, 2025

(65) Prior Publication Data

US 2026/0243139 A1 Aug. 20, 2026

(51) Int. Cl.

| | |
|---|---|
| ***E21B 23/00*** | (2006.01) |
| ***E21B 23/01*** | (2006.01) |
| ***F01K 27/00*** | (2006.01) |

(52) U.S. Cl.
CPC ..... *E21B 23/001* (2020.05); *E21B 23/01* (2013.01); *F01K 27/005* (2013.01)

(58) Field of Classification Search
CPC ..... E21B 23/00; E21B 23/01; E21B 23/001; E21B 23/04; E21B 23/0417; E21B 23/0419; E21B 23/042; E21B 23/0421; E21B 23/0422; F01K 27/005
See application file for complete search history.

(56) References Cited

U.S. PATENT DOCUMENTS

| | | | | |
|---|---|---|---|---|
| 6,843,317 | B2 * | 1/2005 | Mackenzie | E21B 47/00 166/255.2 |
| 7,757,767 | B2 * | 7/2010 | Hill | E21B 23/01 166/212 |
| 8,844,636 | B2 * | 9/2014 | Bebak | E21B 33/126 166/381 |
| 9,002,648 | B2 * | 4/2015 | Pfutzner | G01V 1/16 702/6 |
| 11,268,335 | B2 * | 3/2022 | Vick, Jr. | E21B 23/10 |
| 11,371,303 | B2 * | 6/2022 | Wai | E21B 23/001 |
| 2006/0102347 | A1 * | 5/2006 | Smith | E21B 23/00 166/254.2 |
| 2011/0185806 | A1 * | 8/2011 | Pfutzner | G01V 7/06 73/382 R |
| 2013/0180730 | A1 * | 7/2013 | Bebak | E21B 23/08 166/381 |
| 2013/0240197 | A1 * | 9/2013 | Hallundb | E21B 23/00 166/66.4 |
| 2013/0248174 | A1 * | 9/2013 | Dale | E21B 29/06 166/65.1 |
| 2015/0293065 | A1 * | 10/2015 | Kissell | G01N 33/00 73/865.8 |
| 2023/0407716 | A1 * | 12/2023 | Vick, Jr. | E21B 23/001 |

* cited by examiner

*Primary Examiner* — Dapinder Singh
(74) *Attorney, Agent, or Firm* — Polsinelli PC

(57) ABSTRACT

A geothermal wellbore tractor is provided. The geothermal wellbore tractor can include a hydraulic subsystem, a plurality of wheels in communication with the hydraulic subsystem, and a slick line attachment mechanism in communication with the hydraulic subsystem and engaged to a slick line. Motion of the slick line can be operable to generate power for the hydraulic subsystem. The hydraulic subsystem can be operable to control motion of the plurality of wheels.

19 Claims, 5 Drawing Sheets

HIGH TEMPERATURE GEOTHERMAL WELL TRACTOR

FIELD

The present disclosure relates generally to geothermal well tractors.

BACKGROUND

In recent years, exploration and development of geothermal energy resources have gained significant momentum, driven by the global demand for sustainable and renewable energy sources. Geothermal wells are often characterized by extreme temperatures and challenging subsurface conditions. Tractors are often required to convey tools and tool strings to designated locations within the geothermal well for specific operations. Due to the extreme temperatures and challenging subsurface conditions, tractor placement and movement presents unique operational challenges.

BRIEF DESCRIPTION OF THE DRAWINGS

Implementations of the present technology will now be described, by way of example only, with reference to the attached figures, wherein.

DETAILED DESCRIPTION

Figure 1A:
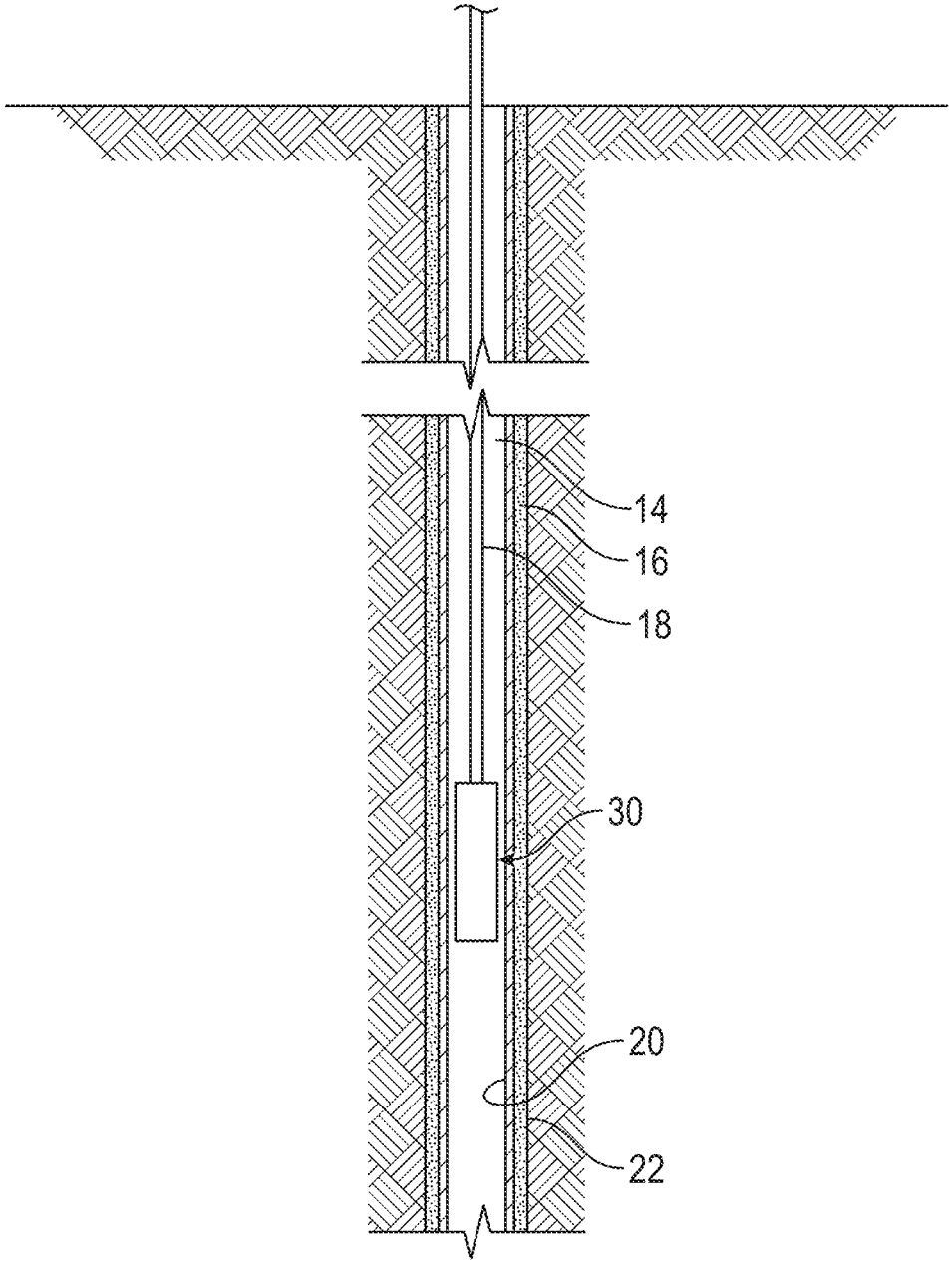
FIG. 1A is a diagram illustrating an exemplary environment for a tool with a tractor according to the present disclosure.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Disclosed herein is a geothermal wellbore tractor for conveying tools and tool strings within a geothermal wellbore. Typically, tractors, tools, and tool strings can be conveyed in geothermal wellbores via gravitational forces. However, traditional methods of deploying wireline tools, such as gravity-assisted conveyance, are ineffective in horizontal, slanted, and other non-vertical wells. In the case of geothermal wells, extreme temperatures and challenging subsurface conditions present unique operational challenges. Additionally, pumping methods, while useful in certain scenarios, are limited by the need for existing perforations or specific well constructions with annular spaces for fluid return.

Effective logging of well integrity, including casing inspection and cement bond inspection, is crucial for ensuring the safety, efficiency, and longevity of geothermal wells. Further, it may be necessary to take remedial action or maintenance to such wells for which tractor operations are also often necessary. In horizontal wells, placing wireline tools accurately and reliably in the desired sections for logging is a fundamental challenge. Addressing the need for precise and reliable placement of wireline tools in horizontal sections is essential for comprehensive well integrity logging. Casing inspection and cement bond inspection are critical tasks that ensure the structural integrity of the wellbore, detect potential issues early, and facilitate timely interventions. However, many of these tools, and the tractors that convey them, require electronic components that quickly degrade in high temperature environments, such as geothermal wellbores. The development of high-temperature tractors is imperative to overcome the limitations of current methods and enhance efficiency and accuracy of geothermal well logging operations.

Figure 1B:
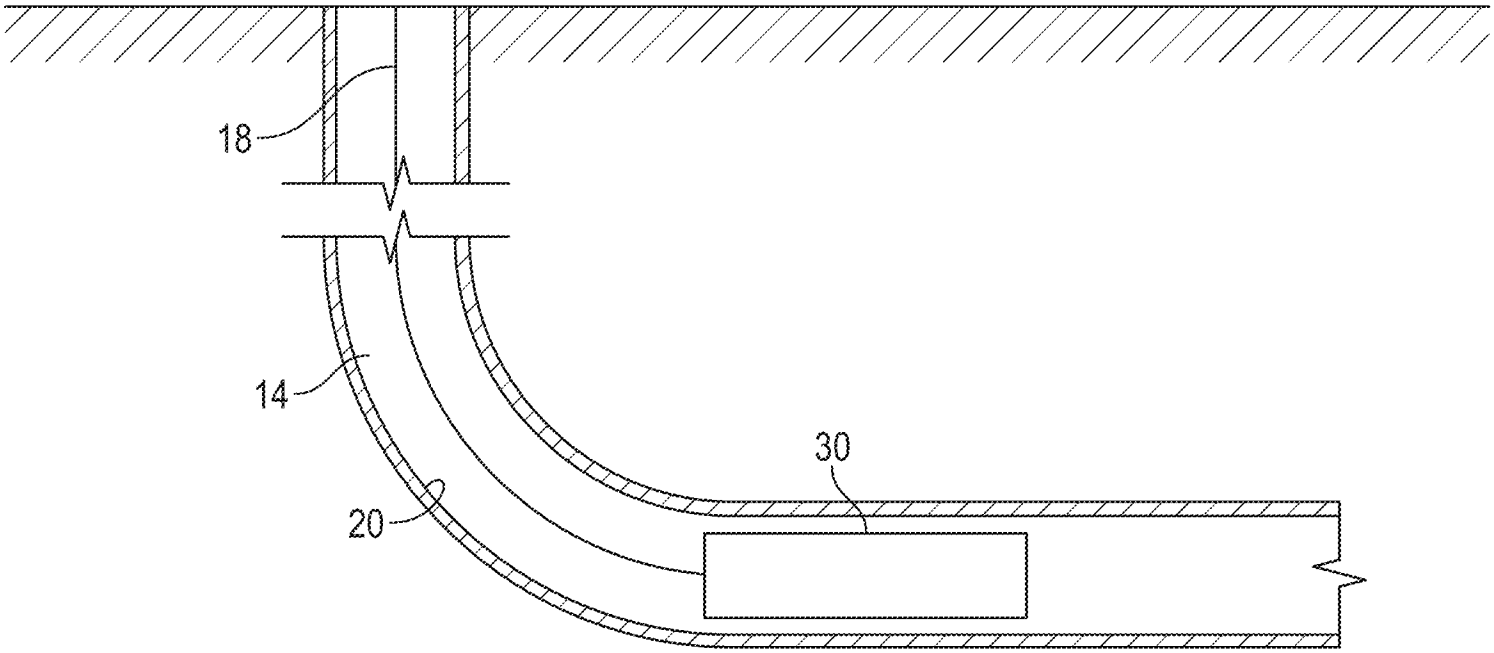
FIG. 1B is a diagram illustrating an exemplary environment for a tool with a tractor according to the present disclosure.

A tractor 30 can be employed in an exemplary wellbore system 10 shown, for example, in FIGS. 1A-1B. The system 10 includes a tractor 30 traversing a wellbore 14.

As illustrated, for example, in FIG. 1A, the wellbore 14 is within an earth formation 22 and has a channel 20 lining the wellbore 14. In some examples, the channel 20 can include a pipeline. In some examples, the channel 20 can include a casing. In some examples, the channel 20 can be held into place by cement 16. The tractor 30 can be disposed within the channel 20 of the wellbore 14 and moved up and/or down the wellbore 14. In some examples, the tractor 30 can be coupled with a conduit 18. In some examples, the tractor 30 can be pulling the conduit 18 through the wellbore 14. The tractor 30 can include, for example, downhole sensors, chokes, and/or valves.

The conduit 18 can be, for example, wireline, slickline, work string, coiled tubing, and/or any other suitable means for conveying downhole tools using a tractor 30 into a wellbore 14. The conduit 18 can be sufficiently strong and flexible to tether to the tractor 30 through the wellbore 14, while also permitting communication through the conduit 18 to one or more of the processors which can include local and/or remote processors.

It should be noted that while FIGS. 1A-B generally depict land-based operations, those skilled in the art would readily recognize that the principles described herein are equally applicable to operations that employ floating or sea-based platforms and rigs, without departing from the scope of the disclosure. As illustrated in FIG. 1B, the tractor 30 can be used in horizontal pipelines and/or wellbores. Further, the tractor 30 can be used in slanted pipelines and/or wellbores, multilateral pipelines and/or wellbores or the like. In some examples, the wellbore system 10 can have a channel 20 already implemented while, in other examples, the system 10 can also be used in open hole applications (e.g., no casing).

Figure 2:
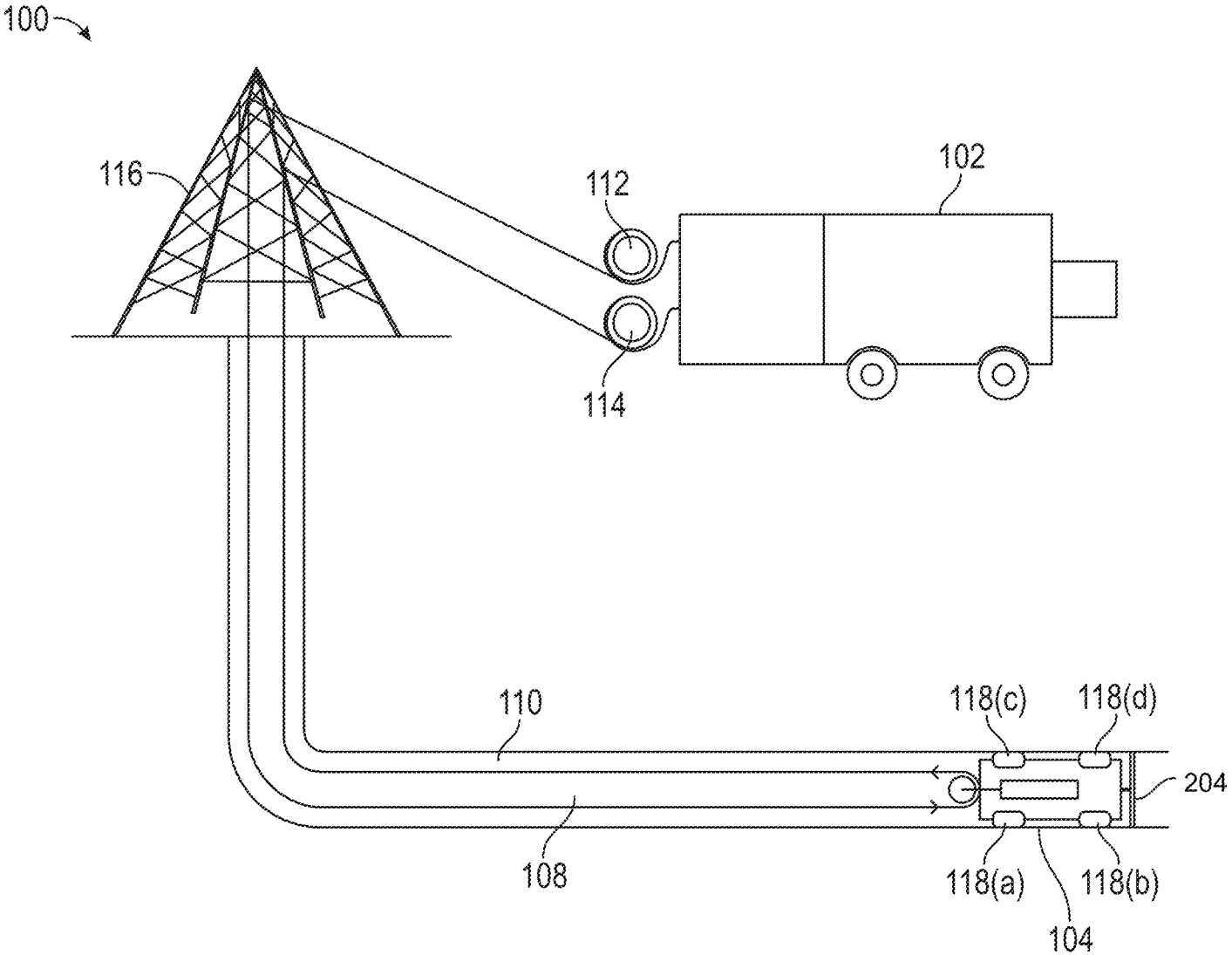
FIG. 2 is a diagram illustrating an exemplary environment for a geothermal wellbore tractor system according to the present disclosure.

FIG. 2 illustrates a geothermal wellbore tractor system 100. The geothermal wellbore tractor system 100 can include a line power subsystem 102 (e.g., a truck), a line guidance support 116, and a geothermal wellbore tractor 104. The line power subsystem 102 can be operable to control motion of one or more lines for conveying tools, conveying the geothermal wellbore tractor 104 (e.g., through vertical wellbore portions), and/or powering the geothermal wellbore tractor 104. In some examples, the one or more lines include a slick line. In some instances, it may be desirable to deploy tractors in extreme temperature wells that are not geothermal wells. Such instances may include, but are not limited to, oil and gas operations, hydrogen operations, critical mineral wells such as those that may produce brines containing abundant minerals for brine mining. It will be appreciated that the geothermal wellbore tractor described herein can be used in any high temperature well.

In some examples, the one or more lines can include a looped line comprising a feed portion 108 and a return portion 110. The feed portion 108 can be guided downhole via a winding drum 112 and the line guidance support 116. The return portion 110 can be guided up hole via the line guidance support 116 and a return drum 114.

Figure 3:
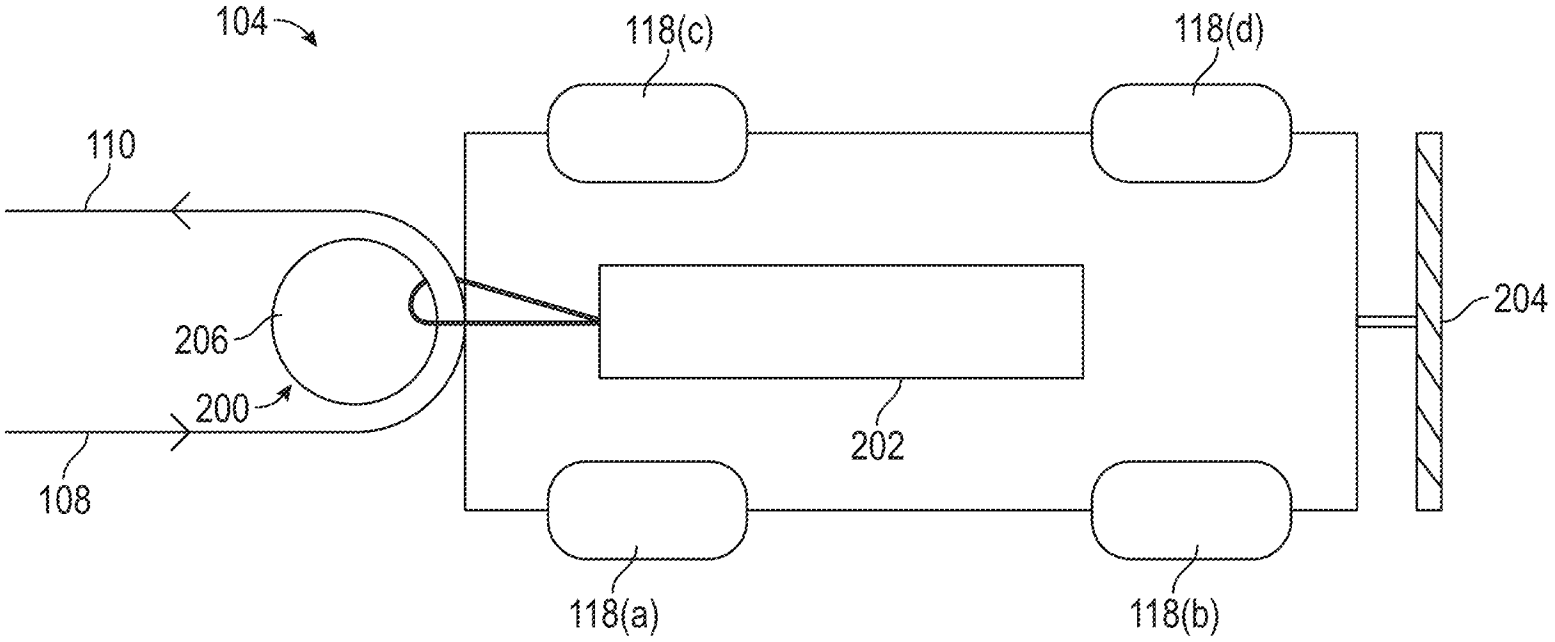
FIG. 3 illustrates a geothermal wellbore tractor according to the present disclosure.

FIG. 3 illustrates a geothermal wellbore tractor 104. The geothermal wellbore tractor 104 can include a hydraulic subsystem 202, a plurality of wheels 118(*a*), 118(*b*), 118(*c*), 118(*d*), and an anchor 204. In some examples, the geothermal wellbore tractor 104 can include a line attachment mechanism (e.g., slick line attachment mechanism). In some examples, the line attachment mechanism can be a pulley assembly 200. In some examples, the line attachment mechanism can be operable to attach to a pump mechanism of the geothermal wellbore tractor 104.

In some examples, the hydraulic subsystem 202 can have an engaged mode and a disengaged mode. In the engaged mode, the hydraulic subsystem 202 can be powered by the pulley assembly 200. The pulley assembly 200 can include a pulley wheel 206. The feed portion 108 and the return portion 110 of the one or more lines (e.g., looped slick line) can be slidably engaged to the pulley wheel 206. As the return portion 110 is pulled up hole by the line power subsystem 102, the pulley wheel 206 can be rotated. As the pulley wheel 206 rotates, the mechanical energy generated by the pulley wheel 206 can be operable to power the hydraulic subsystem 202. (e.g., engaged mode). In the disengaged mode, the feed portion 108 of the one or more lines can be used to position tools downhole towards the geothermal wellbore tractor 104, without causing the geothermal wellbore tractor 104 to move.

The hydraulic subsystem 202 can be operable to provide power to the plurality of wheels 118(*a*), 118(*b*), 118(*c*), 118(*d*) to cause the plurality of wheels to rotate, thereby moving the geothermal wellbore tractor 104 through the geothermal wellbore. The hydraulic subsystem 202 can include a high pressure reservoir, a low pressure reservoir, and a mechanism to allow fluid movement between the high pressure and low pressure reservoirs. The low pressure reservoir can have a lower pressure than the high pressure reservoir. Further the hydraulic system can include a mechanism to produce usable work (e.g., power) from movement of such fluid, for example, one or more pistons or turbines as nonlimiting examples. The fluid of such hydraulic system may benefit from large expansion coefficients including thermal expansion coefficients and compressibility. In operation, for example, in the engaged mode, rotation of the pulley wheel 206 translates power through the hydraulic subsystem to the plurality of wheels 118(*a*), 118(*b*), 118(*c*), 118(*d*). As the pulley wheel 206 rotates, the hydraulic subsystem 202 can cause the plurality of wheels 118(*a*), 118(*b*), 118(*c*), 118(*d*) to rotate or cause other propulsion mechanisms to initiate. In this manner, motion of the geothermal wellbore tractor 104 can be controlled via the feed portion 108 of the one or more lines (e.g., slick line). Although a hydraulic system is desirable, other direct gearing mechanisms of work (e.g., power) transmission are possible.

In some examples, the geothermal wellbore tractor 104 can include a mechanical governor. The mechanical governor can control the rotation rate of the plurality of wheels 118(*a*), 118(*b*), 118(*c*), 118(*d*) such that the movement of the geothermal wellbore tractor 104 is controlled. By controlling the rotation rate of the plurality of wheels 118(*a*), 118(*b*), 118(*c*), 118(*d*) the speed of the geothermal wellbore tractor 104 can be controlled, thereby ensuring smooth and controlled movement within the wellbore.

In some examples, the one or more lines can be operable to control the motion of the geothermal wellbore tractor 104 and/or control actuation of the anchor 204. For example, when the one or more lines are operating in a forward direction (e.g., feed portion 108 moving towards the geothermal wellbore tractor 104), the hydraulic subsystem 202 can cause the plurality of wheels 118(*a*), 118(*b*), 118(*c*), 118(*d*) to rotate in a forward direction. When the one or more lines are operating in a reverse direction (e.g., feed portion 108 moving away from the geothermal wellbore tractor 104), the hydraulic subsystem 202 can cause the wheels 118(*a*), 118(*b*), 118(*c*), 118(*d*) to rotate in a reverse direction (e.g., towards a vertical portion of the geothermal wellbore). The one or more lines may be operated with tugs (e.g., a pull with respect to the tractor). The sequence of the tugs, duration of the tugs, amplitude off the tugs, or combination therein may actuate mechanical positions of the tractor to complete tasks of the tractor such as achieving motion at various speeds, stopping, speeding up or down, or anchoring, or powering the hydraulic or mechanical system as nonlimiting examples.

The one or more lines can also be operable to control the actuation of the anchor 204. For example, a certain procedure (e.g., pattern of forward and reverse motion of the one or more lines) can be used to cause the anchor 204 to anchor to the geothermal wellbore, thereby fixing the geothermal wellbore tractor 104 in place. Similarly, a certain procedure (e.g., pattern of forward and reverse motion of the one or more lines) can be used to cause the anchor 204 to release from an anchored position to an unanchored position, thereby allowing for tractor motion. For example, reversing the direction of motion of the one or more lines can engage or disengage the anchor 204.

The motion of the one or more lines can also provide additional control commands to the geothermal wellbore tractor 104. For example, specific commands can be transmitted to the geothermal wellbore tractor 104 by alternating motion sequences (e.g., loop sequences when the one or more lines include a looped line) between forward and backward movements over set distances. Using the one or more lines motion to transmit commands allows for control over the geothermal wellbore tractor 104 operation without relying on complex electronic communication systems.

In some examples, the geothermal wellbore tractor 104 includes one or more electronic components. Such electronics may be digital or analog. Generally low power analog electronics are more suitable for high temperature operation. However, some flashing may allow digital components to be utilized. The one or more electronic components can include sensors, controllers, and/or other electronic components operable to accurately locate and control the geothermal wellbore tractor 104. In some examples, the one or more electronic components can include high-temperature sensors and analog electronics configured to operate at very low power levels to ensure minimal heat generation and maintain system integrity. In some examples, the one or more electronic components can be powered by the hydraulic subsystem 202. The geothermal wellbore tractor 104 can include a generator and/or alternator. The generator and/or alternator can be operable to siphon off a portion of the hydraulic power generated in the hydraulic subsystem 202. The generator and/or alternator can convert the hydraulic power to electrical energy for powering the one or more electronic components. The use of the hydraulic subsystem 202 or mechanical system to power the one or more electronic components allows for functionality of the one or more electronic components without compromising the thermal resilience of the geothermal wellbore tractor 104.

In some examples, the one or more electronic components can include electromagnetic sensors configured to count casing collars. For example, the electromagnetic sensors can count each casing collar as the geothermal wellbore tractor 104 moves through the wellbore. In this manner, the location of the geothermal wellbore tractor can be determined.

The one or more lines can also be used to provide location and status information of the geothermal wellbore tractor 104. Tension in the one or more lines can be measured. For example, when the one or more lines includes a looped line, the tension on the looped line at the surface can provide status and operation conditions of the geothermal wellbore tractor. In some examples, the tension on the looped line and the length of looped line used to position the geothermal wellbore tractor 104 can be converted into location information. For example, when a known length of the looped line is used to position the geothermal wellbore tractor 104, the location of the geothermal wellbore tractor 104 within a horizontal wellbore can be calculated.

In some examples, the geothermal wellbore tractor 104 can include a mechanical energy system. The mechanical energy system can be in addition to, or an alternative of, the hydraulic subsystem 202. In some examples, the mechanical energy system can be a direct drive mechanical energy system. The mechanical energy system can include a gear system. The gear system can be operable to convert the mechanical energy from the one or more lines (e.g., slick line), via the line attachment mechanism (e.g., pulley assembly 200), directly into motion of the plurality of wheels 118(*a*), 118(*b*), 118(*c*), 118(*d*). For example, as the one or more lines (e.g., slick line) rotate the pulley wheel 206, the pulley wheel 206 can translate power to the gear system, which in turn causes the plurality of wheels 118(*a*), 118(*b*), 118(*c*), 118(*d*) to rotate. In some examples, hydraulic power from the hydraulic subsystem 202 can be less effective than mechanical power. The mechanical energy system can be operable to provide an alternative form of power to control the motion of the geothermal wellbore tractor 104.

In some examples, the one or more lines can be interchangeable. Once the geothermal wellbore tractor 104 is anchored into position (e.g., via the anchor 204), the one or more lines can be gradually increased to higher strength lines. When the one or more lines include a looped slick line, higher strength lines can be incrementally positioned. For example, the feed portion 108 of the one or more lines can be attached to a higher strength slick line. The higher strength slick line can then be run down through the pulley assembly 200 and back up to the line power subsystem 102. This process can be repeated until a high strength slick line and/or wireline is in place within the pulley assembly 200. The final high strength slick line and/or wireline can be of sufficient strength to pull wireline tools and/or the geothermal wellbore tractor 104. By gradually increasing the line strength, the risk of failure of the line is reduced. Further, the final slick line and/or wireline has sufficient strength to manage the weight and friction associated with the tool string. In this manner, operators can efficiently and safely position tools (e.g., wireline tools) in the horizontal section of the well, thereby facilitating effective logging and well integrity assessment.

The final slickline and/or wireline can be operable to locate one or more tools within the wellbore. In some examples, the one or more tools can be one or more wireline tools. In some examples, the one or more tools can include a water hammer, an azimuthal cement bond evaluation system, or other tools for logging and well integrity evaluation. In some examples, the transit time of the one or more tools to the geothermal wellbore tractor 104 can be used to provide location data for the geothermal wellbore tractor. For example, when the one or more tools are traveling at a known speed and the transit time to the geothermal wellbore tractor is measured, the location of the geothermal wellbore tractor 104 can be determined.

In some examples, the final slickline and/or wireline can be locked into position with the geothermal wellbore tractor 104. For example, once the tractor is anchored (e.g., via anchor 204), and the proper strength slickline and/or wireline has been used to properly locate the tool string in the geothermal wellbore, the slickline and/or wireline can be locked into position with the geothermal wellbore tractor 104. In some examples, the slickline and/or wireline can be locked into position via a mechanical locking mechanism and/or an electronic locking mechanism. Locking the final slickline and/or wireline into position can cause the hydraulic subsystem 202 to enter one or more additional modes. For example, when the final slickline and/or wireline is locked into position with the geothermal wellbore tractor 104, the geothermal wellbore tractor 104 can enter the disengaged mode, allowing the geothermal wellbore tractor 104 to remain stationary while other operations are conducted including powering the hydraulic system.

In some examples, the one or more additional modes can include a reverse mode. In the reverse mode, the geothermal wellbore tractor 104 can be dragged along the wellbore by the final slick line and/or wireline, thereby causing the plurality of wheels 118(*a*), 118(*b*), 118(*c*), 118(*d*) to rotate. The reverse mode can be used when the geothermal wellbore tractor 104 is being pulled out of the wellbore. For example, when the geothermal wellbore tractor 104 is located at an end of a horizontal portion of a wellbore (e.g., distal to a vertical portion of the wellbore), the geothermal wellbore tractor 104 can be placed in the reverse mode and dragged along the horizontal portion of the wellbore towards the vertical portion of the wellbore, thereby rotating the plurality of wheels 118(*a*), 118(*b*), 118(*c*), 118(*d*). As the plurality of wheels 118(*a*), 118(*b*), 118(*c*), 118(*d*) rotate, power can be generated in the hydraulic subsystem 202 or mechanical subsystem. In this manner, for example hydraulic power can be generated as the geothermal wellbore tractor 104 is being pulled out of the wellbore. The hydraulic power can then be used to power one or more tools of the tool string, thereby allowing the tools to conduct operations within the wellbore. Additionally, the hydraulic power can be used to power the one or more electronic components described herein.

In some examples, the one or more tools can include one or more azimuthal inspection tools. For example, the one or more azimuthal inspection tools can include an azimuthal cement bond evaluation system, an azimuthal casing inspection tool, or other azimuthal tools. The one or more azimuthal inspection tools can include a rotating section powered by a motor. Typically, azimuthal inspection tools require significant power. For example, the motor can be a 600-watt motor. The motor control, associated with electronics, and the heat generated during operation pose significant challenges similar to those encountered by standard wellbore tractors, especially in high temperature environments. By using the hydraulic power generated by the plurality of wheels 118(*a*), 118(*b*), 118(*c*), 118(*d*) as the geothermal wellbore tractor 104 is pulled through the wellbore, these issues can be mitigated. The hydraulic subsystem 202 can drive the rotating section, eliminating the need for high-power electronics and reducing heat generation, thereby providing reliable and efficient operation of the one or more azimuthal inspection tools under extreme conditions associated with geothermal wells and ensuring accurate and effective well integrity assessments. Such configuration benefits from a hydraulic or mechanical power line throughout the string of equipment that may be used for powering such equipment in a non-electrical fashion. Non limiting examples of mechanical power system include a rotating shaft or rotating chain. Such rotating shaft may be flexible or contain segmented joints.

In some examples, the mechanical governor described herein, or another mechanical governor, can also be operable to control the rotation rate of the one or more azimuthal inspection tools. The mechanical governor can ensure that the rotation rate of the rotating section of the one or more azimuthal inspection tools remains constant. The constant rotation rate allows for precise and accurate measurements of cement bonds, casing integrity, and/or other measurements made by the one or more azimuthal inspection tools.

In some examples, the geothermal wellbore tractor system 100 can further include one or more generators powered by the one or more lines and/or the reverse rotation of the plurality of wheels 118(*a*), 118(*b*), 118(*c*), 118(*d*). For example, each tool on a tool string can include a generator and/or pulley assembly 200. As the one or more lines rotate the pulley wheel 206, hydraulic power can be used to power each of the generators. In this manner, the generators can power each tool in the tool string. Additionally, the reverse rotation of the plurality of wheels 118(*a*), 118(*b*), 118(*c*), 118(*d*), can be used to power the hydraulic subsystem 202 which can be used to power the one or more generators. In some examples, the generators use the hydraulic power directly to control motion of the one or more tools. In some examples, the generators can be operable to convert the hydraulic power to electric power for operating the one or more tools.

In some examples, the one or more lines can be operable to power the geothermal wellbore tractor 104 in a push system. In this example, the geothermal wellbore tractor 104 is positioned at the head of the tool string. The one or more lines can include the looped slick line, and similar to the above system, the looped slick line can power the hydraulic subsystem 202 to provide control over movement of the geothermal wellbore tractor 104. The push system can reduce the tension on the looped slick line.

In some examples, the one or more lines can include a terminating single slick line rather than a looped line. In this example, the single slick line is operable to alternatively pull and release a pumping mechanism attached to the geothermal wellbore tractor 104. The pumping mechanism can be attached to the single slick line via a line attachment of the geothermal wellbore tractor 104. In some examples, the geothermal wellbore tractor 104 is anchored by the anchor 204 as the slickline alternatively pulls and releases the pumping mechanism. The pumping mechanism can be operable to charge the hydraulic subsystem 202. In some examples, the slick line action can intermittently or continuously charge the hydraulic subsystem 202 via the pumping mechanism. The hydraulic subsystem 202 can then be used to control the motion of the plurality of wheels 118(*a*), 118(*b*), 118(*c*), 118(*d*) and/or the tools in the tool string, as described herein.

Regardless of the configuration of the one or more lines, accurate control of the one or more lines at the surface is required for operating the geothermal wellbore tractor 104 and/or utilizing the geothermal wellbore tractor 104 as a generator for hydraulic and/or electric power. To control the one or more lines, and thereby the geothermal wellbore tractor 104, tension and positioning of the one or more lines can be monitored. For example, the winding drum 112 is operable to release the one or more lines at a faster rate than the return drum 114 to compensate for increased distance as the geothermal wellbore tractor 104 moves further into the wellbore. Similarly, when the geothermal wellbore tractor 104 is being pulled back to the surface, the return drum 114 pulls the one or more lines at a faster rate than the winding drum 112 releases the one or more lines.

One or two way communication between the geothermal wellbore tractor 104 and the operator at the surface can be accomplished using the tension in the wire (e.g., as described herein) and with other communication methods. In some examples, the one or more lines can be e-lines (e.g., having a single conductor). In some examples, pulsed telemetry can be used to enable two way communication between the geothermal wellbore tractor 104 and the operator at the surface. In some examples, optical telemetry can be used to enable two way communication between the geothermal wellbore tractor 104 and the operator at the surface. The geothermal wellbore tractor 104 can position a reflector for water hammer communication with the position of the reflector changing the nature of the water hammer reflection such that information is conveyed to surface with minimal power consumption of the geothermal wellbore tractor 104. Alternatively, the tractor may drag a fiber optic with modulation of the fiber optic performed downhole by the geothermal wellbore tractor 104 and the power source for the fiber optic at surface. In other examples, the tractor may use the slick line to provide a conduit for communication by electrical, optical, or mechanical means. Modulation may be accomplished mechanically, acoustically, electrically or magnetically. Such modulation may be digital or analog in both modulation form and in transmitted information, or a combination thereof.

In some examples, when pulsed telemetry is used to enable two way communication, pulse signals can communicate control commands to the geothermal wellbore tractor 104 and receive feedback from the geothermal wellbore tractor 104, providing a method for data transmission. Pulsed telemetry can be configured to withstand high temperatures, ensuring reliable communication in geothermal wells. Pulsed telemetry can also have low power requirements to operate, reducing heat generation and enhancing efficiency.

In some examples, the e-line can combine power delivery and data communication though a single conductor. The e-line can provide a high data transmission rate compared to traditional mechanical or pulsed methods. The e-line can be adapted for high-temperature environments using appropriate insulation.

In some examples, optical telemetry can be used to enable two way communication between the geothermal wellbore tractor 104 and an operator at the surface. Geothermal wells are typically brine-filled and somewhat clear. Optical telemetry can be achieved using high-temperature flash optics (e.g., xenon flash). Optical telemetry can provide high data transmission rates, suitable for complex data requirements of the one or more tools. In some examples, optical telemetry can be accomplished using high-temperature tolerant materials, such as xenon flash. Optical telemetry can provide accurate positioning and operational data of the geothermal wellbore tractor 104 and the one or more tools. Alternatively, the optical transmission may use modulation or reflection of surface optical signals.

Figure 4:
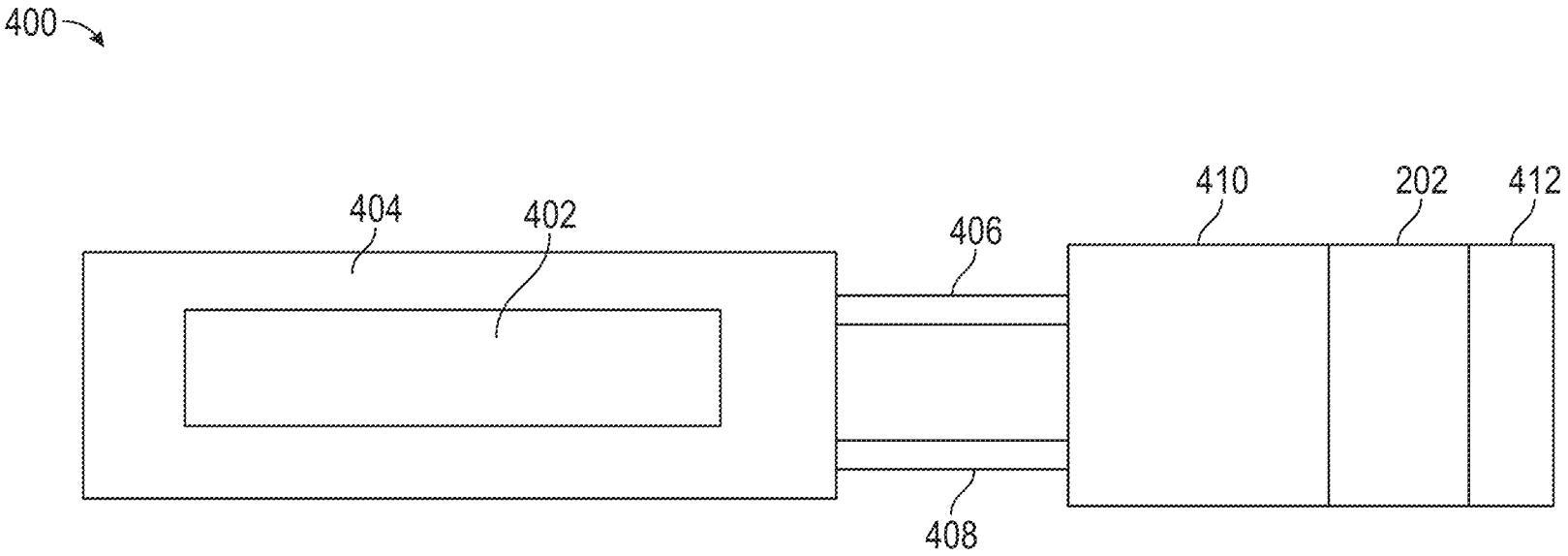
FIG. 4 illustrates a chemical steam system for a geothermal wellbore tractor according to the present disclosure.

FIG. 4 illustrates a chemical steam system 400 of the geothermal wellbore tractor 104. The chemical steam system 400 can be operable to generate hydraulic power. In some examples, the chemical steam system 400 can be used in conjunction with, or as an alternative to, the methods and systems for generating hydraulic power described herein. The chemical steam system 400 can be operable to provide hydraulic power to the hydraulic subsystem 202 for the operations described herein. Steam herein refers to a high pressure fluid such as that obtained from a phase transition of a fluid from a liquid to gas state or supercritical state. Alternatively, in some fluid systems, thermal or bulk expansion may be used with or without a phase transition to produce a high pressure fluid including but not limited to liquid to liquid, gas to gas, supercritical to supercritical.

The chemical steam system 400 can include a first chamber 402, a second chamber 404, a low pressure line 406, a high pressure line 408, a steam engine 410, the hydraulic subsystem 202, and an electric generator 412. The second chamber 404 can surround the first chamber 402. The first chamber 402 can be operable to contain a first compound. The second chamber 404 can be operable to contain a second compound. The first compound can be operable to exothermically react with the second compound, thereby producing steam. The steam can flow through the high pressure line 408 and drive the steam engine 410. As the steam engine 410 is driven, hydraulic power can be generated and power the hydraulic subsystem 202. In this manner, the hydraulic subsystem 202 can provide the hydraulic power needed to perform the various functions described herein. As described herein, the electric generator 412 can be operable to convert the hydraulic power in the hydraulic subsystem 202 into electric power for powering the one or more electronic components of the geothermal wellbore tractor 104 and/or the electronic components of the one or more tools.

In some examples, the first compound is water, and the second compound is barium oxide. The second chamber 404 can be a reaction chamber containing the barium oxide. The second chamber 404 surrounds the first chamber 402 which contains the water. The exothermic reaction between barium oxide and water heats the water above ambient temperature, producing steam at high pressures. The high-pressure steam can then drive the steam engine 410 to generate hydraulic power for the hydraulic subsystem 202. The exothermic reaction eliminates the need for external heating sources. As the steam is produced, it reacts with the barium oxide, maintaining a controlled pressure within the chemical steam system 400. The continuous steam generation cycle ensures reliable and efficient hydraulic power generation.

In some examples, the first compound can include water, ammonia, and/or formic acid. The second compound can include barium oxide, calcium sulfate, calcium oxide, magnesium oxide, phosphorous pentoxide, silicon tetrachloride, sulfur trioxide, aluminum chloride, and/or zinc chloride.

In some examples, the chemical steam system 400 utilizes reactions that produce condensed phase products from precursors (e.g., second compounds contained in the second chamber 404), such as calcium sulfate, calcium oxide, magnesium oxide, phosphorous pentoxide, silicon tetrachloride, sulfur trioxide, aluminum chloride, and zinc chloride, which offers a viable alternative for high-pressure steam generation and hydraulic power production. These chemicals react exothermically with water, generating significant heat and forming stable condensed phases, such as hydrates or other solid compounds. The reaction allows for efficient steam production without the need for external cooling systems to condense the steam, as the steam is chemically absorbed or reacted away. For example, calcium sulfate reacts with water to form gypsum, while calcium oxide forms calcium hydroxide. Similarly, magnesium oxide and phosphorus pentoxide form magnesium hydroxide and phosphoric acid, respectively. These reactions generate the necessary heat to produce high-pressure steam and also maintain manageable pressure levels within the chemical steam system 400.

In other examples, the first compound can be liquid ammonia and the second compound (e.g., precursor) can be hydrogen chloride, which produces high-pressure steam via exothermic reactions and produces condensed ammonium chloride. In another example, the first compound can be liquid formic acid and the second compound (e.g., precursor) can be sodium hydroxide, which produces high-pressure steam via exothermic reactions and produces condensed sodium formate and sodium bicarbonate. In some examples, the first compound may be obtained from the wellbore environment, such as water drawn from a water based drilling fluid.

Numerous examples are provided herein to enhance understanding of the present disclosure. A specific set of statements are provided as follows.

Statement 1: A geothermal wellbore tractor comprising: a hydraulic subsystem; a plurality of wheels in communication with the hydraulic subsystem; and a slick line attachment mechanism in communication with the hydraulic subsystem and engaged to a slick line, wherein motion of the slick line is operable to generate power for the hydraulic subsystem, and wherein the hydraulic subsystem is operable to control motion of the plurality of wheels.

Statement 2: The geothermal wellbore tractor of Statement 2, wherein the slick line attachment mechanism comprises a pulley assembly comprising: a pulley wheel; and the slick line slidably engaged to the pulley wheel, wherein the pulley wheel is in communication with the hydraulic subsystem, wherein the pulley wheel is operable to be rotated by the slick line to generate power for the hydraulic subsystem, and wherein the slick line is a looped slick line.

Statement 3: The geothermal wellbore tractor of Statement 1 or Statement 2, further comprising an anchor.

Statement 4: The geothermal wellbore tractor of any one of Statements 1-3, wherein the hydraulic subsystem comprises an engaged mode and a disengaged mode.

Statement 5: The geothermal wellbore tractor of Statement 4, wherein in the engaged mode, the hydraulic subsystem is operable to cause the plurality of wheels to rotate, thereby moving the geothermal wellbore tractor through a geothermal wellbore.

Statement 6: The geothermal wellbore tractor of Statement 4 or 5, wherein in the disengaged mode, the slick line travels around the pulley wheel to convey one or more tools along the slick line.

Statement 7: The geothermal wellbore tractor of any one of Statements 5-7, wherein motion of the plurality of wheels is controlled by motion of the slick line.

Statement 8: The geothermal wellbore tractor of any one of Statements 1-7, wherein the slick line is operable to provide feedback on motion of the geothermal wellbore tractor.

Statement 9: The geothermal wellbore tractor of any one of Statements 1-8, wherein the hydraulic subsystem is operable to power one or more tools.

Statement 10: The geothermal wellbore tractor of Statement 1, further comprising a chemical steam subsystem in communication with the hydraulic subsystem and operable to generate power for the hydraulic subsystem, the chemical steam subsystem comprising: a first chamber operable to contain a first compound; a second chamber surrounding the first chamber, the second chamber operable to contain a second compound; and a steam engine.

Statement 11: The geothermal wellbore tractor of Statement 10, wherein the first compound comprises water, ammonia, and/or formic acid.

Statement 12: The geothermal wellbore tractor of Statement 11, wherein the second compound comprises barium oxide, calcium sulfate, calcium oxide, magnesium oxide, phosphorus pentoxide, silicon tetrachloride, sulfur trioxide, aluminum chloride, and/or zinc chloride.

Statement 13: The geothermal wellbore tractor of any one of Statements 10-12, wherein the first compound exothermically reacts with the second compound to produce steam, wherein the steam engine converts the steam to hydraulic power.

Statement 14: A geothermal wellbore system comprising: a slick line; a geothermal wellbore tractor comprising: a hydraulic subsystem; a plurality of wheels in communication with the hydraulic subsystem; an anchor; and a slick line attachment mechanism in communication with the hydraulic subsystem and engaged to the slick line; and a slick line truck operable to control motion of the slick line, wherein the motion of the slick line is operable to generate power for the hydraulic subsystem, and wherein the hydraulic subsystem is operable to control motion of the plurality of wheels.

Statement 15: The geothermal wellbore system of Statement 14, wherein the slick line attachment mechanism comprises a pulley assembly comprising: a pulley wheel; and the slick line slidably engaged to the pulley wheel, wherein the pulley wheel is in communication with the hydraulic subsystem, wherein the pulley wheel is operable to be rotated by the slick line to generate power for the hydraulic subsystem, and wherein the slick line is a looped slick line.

Statement 16: The geothermal wellbore system of Statement 15, wherein the hydraulic subsystem comprises an engaged mode and a disengaged mode.

Statement 17: The geothermal wellbore system of Statement 16, wherein in the engaged more, the hydraulic subsystem is operable to cause the plurality of wheels to rotate, thereby moving the geothermal wellbore tractor through a geothermal wellbore.

Statement 18: The geothermal wellbore system of any one of Statements 14-17, further comprising one or more wireline tools engaged with the slick line, wherein the hydraulic subsystem is operable to power the one or more wireline tools.

Statement 19: A geothermal wellbore tool power source comprising: A hydraulic subsystem; and a chemical steam subsystem in communication with the hydraulic subsystem and operable to provide power to the hydraulic subsystem, the chemical steam subsystem comprising: a first chamber operable to contain a first compound; a second chamber surrounding the first chamber and operable to contain a second compound; and a steam engine, wherein the first compound exothermically reacts with the second compound to produce high pressure steam, and wherein the steam engine converts the high pressure steam to hydraulic power for the hydraulic subsystem.

Statement 20: The geothermal wellbore tool power source of Statement 19, wherein the hydraulic subsystem powers one or more wireline tools.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A geothermal wellbore tractor comprising:

a hydraulic subsystem;

a plurality of wheels in communication with the hydraulic subsystem;

a slick line attachment mechanism in communication with the hydraulic subsystem and engaged to a slick line;

a chemical steam subsystem in communication with the hydraulic subsystem and operable to generate power for the hydraulic subsystem, the chemical steam subsystem comprising:

a first chamber operable to contain a first compound;

a second chamber surrounding the first chamber, the second chamber operable to contain a second compound; and a steam engine, wherein motion of the slick line is operable to generate power for the hydraulic subsystem, and wherein the hydraulic subsystem is operable to control motion of the plurality of wheels.

2. The geothermal wellbore tractor of claim 1, wherein the slick line attachment mechanism comprises a pulley assembly comprising:

a pulley wheel; and the slick line slidably engaged to the pulley wheel, wherein the pulley wheel is in communication with the hydraulic subsystem, wherein the pulley wheel is operable to be rotated by the slick line to generate power for the hydraulic subsystem, and wherein the slick line is a looped slick line.

3. The geothermal wellbore tractor of claim 2, further comprising an anchor.

4. The geothermal wellbore tractor of claim 3, wherein the hydraulic subsystem comprises an engaged mode and a disengaged mode.

5. The geothermal wellbore tractor of claim 4, wherein in the engaged mode, the hydraulic subsystem is operable to cause the plurality of wheels to rotate, thereby moving the geothermal wellbore tractor through a geothermal wellbore.

6. The geothermal wellbore tractor of claim 4, wherein in the disengaged mode, the slick line travels around the pulley wheel to convey one or more tools along the slick line.

7. The geothermal wellbore tractor of claim 5, wherein motion of the plurality of wheels is controlled by motion of the slick line.

8. The geothermal wellbore tractor of claim 1, wherein the slick line is operable to provide feedback on motion of the geothermal wellbore tractor.

9. The geothermal wellbore tractor of claim 1, wherein the hydraulic subsystem is operable to power one or more tools.

10. The geothermal wellbore tractor of claim 1, wherein the first compound comprises water, ammonia, and/or formic acid.

11. The geothermal wellbore tractor of claim 10, wherein the second compound comprises barium oxide, calcium sulfate, calcium oxide, magnesium oxide, phosphorus pentoxide, silicon tetrachloride, sulfur trioxide, aluminum chloride, and/or zinc chloride.

12. The geothermal wellbore tractor of claim 1, wherein the first compound exothermically reacts with the second compound to produce steam, wherein the steam engine converts the steam to hydraulic power.

13. A geothermal wellbore system comprising:

a slick line;

a geothermal wellbore tractor comprising:

a hydraulic subsystem;

a plurality of wheels in communication with the hydraulic subsystem;

an anchor;

a slick line attachment mechanism in communication with the hydraulic subsystem and engaged to the slick line;

a chemical steam subsystem in communication with the hydraulic subsystem and operable to generate power for the hydraulic subsystem, the chemical steam subsystem comprising:

a first chamber operable to contain a first compound;

a second chamber surrounding the first chamber, the second chamber operable to contain a second compound; and a steam engine; and a slick line truck operable to control motion of the slick line, wherein motion of the slick line is operable to generate power for the hydraulic subsystem, and wherein the hydraulic subsystem is operable to control motion of the plurality of wheels.

14. The geothermal wellbore system of claim 13, wherein the slick line attachment mechanism comprises a pulley assembly comprising:

a pulley wheel; and the slick line slidably engaged to the pulley wheel, wherein the pulley wheel is in communication with the hydraulic subsystem, wherein the pulley wheel is operable to be rotated by the slick line to generate power for the hydraulic subsystem, and wherein the slick line is a looped slick line.

15. The geothermal wellbore system of claim 14, wherein the hydraulic subsystem comprises an engaged mode and a disengaged mode.

16. The geothermal wellbore system of claim 15, wherein in the engaged mode, the hydraulic subsystem is operable to cause the plurality of wheels to rotate, thereby moving the geothermal wellbore tractor through a geothermal wellbore.

17. The geothermal wellbore system of claim 13, further comprising one or more wireline tools engaged with the slick line, wherein the hydraulic subsystem is operable to power the one or more wireline tools.

18. A geothermal wellbore tool power source comprising:

a hydraulic subsystem; and a chemical steam subsystem in communication with the hydraulic subsystem and operable to provide power to the hydraulic subsystem, the chemical steam subsystem comprising:

a first chamber operable to contain a first compound;

a second chamber surrounding the first chamber and operable to contain a second compound; and a steam engine, wherein the first compound exothermically reacts with the second compound to produce high pressure steam, and wherein the steam engine converts the high pressure steam to hydraulic power for the hydraulic subsystem.

19. The geothermal wellbore tool power source of claim 18, wherein the hydraulic subsystem powers one or more wireline tools.

* * * * *